US012729903B2

(12) United States Patent
Tanaka et al.

(10) Patent No.: US 12,729,903 B2
(45) Date of Patent: Sep. 8, 2026

(54) AUTOMATED FROZEN GOODS DISPENSER

(71) Applicant: Lab2Fab, LLC, Fremont, CA (US)

(72) Inventors: Samuel Lewis Tanaka, San Leandro, CA (US); Cory David Lent, Campbell, CA (US); John Paul Norman, San Jose, CA (US)

(73) Assignee: Lab2Fab LLC, Fremont, CA (US)

( * ) Notice: Subject to any disclaimer, the term of this patent is extended or adjusted under 35 U.S.C. 154(b) by 569 days.

(21) Appl. No.: 18/096,388

(22) Filed: Jan. 12, 2023

(65) Prior Publication Data

US 2023/0221064 A1 Jul. 13, 2023

Related U.S. Application Data

(60) Provisional application No. 63/299,334, filed on Jan. 13, 2022.

(51) Int. Cl.
*F25D 25/00* (2006.01)

(52) U.S. Cl.
CPC ..... *F25D 25/005* (2013.01); *F25D 2300/00* (2013.01); *F25D 2331/806* (2013.01)

(58) Field of Classification Search
CPC ..... F25D 25/005
See application file for complete search history.

(56) References Cited

U.S. PATENT DOCUMENTS 3,351,233 A 11/1967 Chanoch et al.
5,144,879 A 9/1992 Alessi
5,168,795 A * 12/1992 Okada ..... G07F 17/0078 99/336
5,238,145 A * 8/1993 Pippin ..... B65G 1/08 221/270
5,353,847 A * 10/1994 Cahlander ..... B65B 37/08 141/168
8,121,727 B2 * 2/2012 Mosey ..... G07F 11/165 221/133
2005/0193898 A1 9/2005 Sus et al.
(Continued)

FOREIGN PATENT DOCUMENTS

WO 2022076558 A1 4/2022
WO 2023075620 A1 5/2023

OTHER PUBLICATIONS

International Search Report and Written Opinion of the International Searching Authority in relation to International Application No. for PCT application No. PCT/US2023/010709,dated May 10, 2023, 8 pages.

*Primary Examiner* — Gene O Crawford
*Assistant Examiner* — Ayodeji T Ojofeitimi
(74) *Attorney, Agent, or Firm* — Van Hoven PC; Jeremy Plenzler; Joshua Van Hoven

(57) ABSTRACT

Apparatuses, systems, and methods are presented herein for dispensing a frozen food item from storage. A food dispensing apparatus comprises a food storage cabinet, a plurality of storage bins within the cabinet, and a plurality of actuators corresponds to the plurality of storage bins. The food storage cabinet is configured to maintain a plurality of consumable items at a storage temperature. The plurality of storage bins are each configured to hold one of the consumable items. The plurality of actuators are each configured to move the consumable item out of the storage bin to a dispensing area.

12 Claims, 7 Drawing Sheets

(56) References Cited

U.S. PATENT DOCUMENTS

| | | | | |
|---|---|---|---|---|
| 2006/0102645 | A1* | 5/2006 | Walker | G06Q 30/0223 221/75 |
| 2009/0076650 | A1* | 3/2009 | Faes | G07F 11/42 700/231 |
| 2009/0283539 | A1* | 11/2009 | Borra | G07F 11/36 221/258 |
| 2010/0025422 | A1* | 2/2010 | Bjornvall | G07F 9/105 219/756 |
| 2014/0367403 | A1* | 12/2014 | Carpentier | G07F 11/163 221/12 |
| 2017/0208940 | A1 | 7/2017 | Boudreault | |
| 2018/0213813 | A1 | 8/2018 | Lenssen et al. | |
| 2018/0290777 | A1 | 10/2018 | Martin | |
| 2018/0308308 | A1 | 10/2018 | Castellano | |
| 2019/0208964 | A1 | 7/2019 | Bauer et al. | |
| 2023/0100374 | A1 | 3/2023 | Ben-David et al. | |

* cited by examiner

AUTOMATED FROZEN GOODS DISPENSER

CROSS-REFERENCE TO RELATED APPLICATIONS

This application claims the benefit of U.S. Provisional Patent Application No. 63/299,334 filed Jan. 13, 2022, the disclosure of which is hereby incorporated by reference herein in its entirety.

INTRODUCTION

The present disclosure is directed to apparatuses, systems, and methods for dispensing frozen goods, and more particularly, to apparatuses, systems and methods that move a stored item from a storage area to a dispensing area.

BACKGROUND

Robotic automated food preparation systems have been developed for automating various kitchen operations of a restaurant. For example, each of U.S. patent application Ser. No. 17/494,664 (filed on Oct. 5, 2021) and U.S. Provisional Patent Application Ser. No. 63/088,162 (filed on Oct. 6, 2020) disclose examples of robotic automated food preparation systems that may be used to fry consumable items such as french fries, onion rings, chicken, etc.

Consumable items may be initially stored in a cabinet, freezer, or other storage device, and measured out or metered for processing in a robotic automated fryer system. Generally, robotic automated food preparation systems require relatively precisely portioned goods to be dispensed on demand to meet throughput and cooking needs. Poor quality food and waste may result from errors in the number of consumable items dispensed or delivered to preparation devices such as fryers. This is particularly the case for larger food items such as chicken strips or nuggets that are typically served in specified numerical quantities (e.g., a 3-pack, 6-pack, etc.) rather than specific weights or volumes.

SUMMARY

Example illustrations herein are directed to a food dispensing apparatus that includes a cabinet configured to maintain a plurality of consumable items at a storage temperature. The cabinet may generally be any climate controlled enclosure such as a freezer, refrigerator, a warming oven, enclosure with heat lamps, or other food storage device configured to maintain the consumable items at a desired temperature, e.g., below room/ambient temperature such as a refrigerated temperature or temperature at which food items tend to be frozen. Merely as examples, refrigerated temperatures generally may include temperatures of 40 degrees Fahrenheit/4 degrees Celsius or below, while temperatures at which food items tend to be frozen includes temperatures of 0 degrees Fahrenheit/−17 degrees Celsius or below. In an example, consumable items are frozen chicken strips or nuggets, which are desirably kept at a frozen temperature without substantial thawing prior to placing into a fryer.

In some embodiments, the disclosure is directed to a food dispensing apparatus comprising a food storage cabinet, a plurality of storage bins within the cabinet, and a plurality of actuators corresponding to the plurality of storage bins. The food storage cabinet is configured to maintain a plurality of consumable items at a storage temperature. The plurality of storage bins are each configured to hold one of the consumable items. The plurality of actuators are each configured to move the consumable item out of the storage bin to a dispensing area. The actuators may each comprise a plunger configured to force the consumable item out of the storage bin in a consumable item movement direction. For example, the actuators may each comprise a spring biasing the plunger in the consumable item movement direction.

In some embodiments, each of the storage bins are configured to hold a same number of consumable items. For example, each of the storage bins may be configured to hold a single consumable item. In some embodiments, the apparatus further comprises a storage grid including the plurality of storage bins, wherein the storage grid is configured to be removed from the cabinet for loading the consumable items into the storage bins. In some embodiments, the cabinet is a freezer. In some embodiments, the apparatus further comprises an accumulator chute configured to receive one or more consumable items from at least one of the plurality of storage bins, and a pneumatic ejector configured to translate the one or more consumable items towards an opening in the cabinet along an ejection path.

In some embodiments, the disclosure is directed to an automated food preparation system. The automated food preparation system comprises the discuss food dispensing apparatus and a robot configured to move a plurality of consumable items from the dispensing area of the food dispensing apparatus to a food processing device. In some embodiments, the food processing device comprises a fryer.

In some embodiments, the disclosure is directed to a method for dispensing consumable items. The consumable items are stored at a storage temperature (e.g., corresponding to an operation temperature of one or more of a freezer, a refrigerator, a cooler, or related apparatus) within a cabinet in a plurality of storage bins. One or more of the consumable items is dispensed from their respective storage bins with one or more actuators corresponding to the plurality of storage bins holding the one or more consumable items, thereby moving the one or more consumable items to a dispensing area. In some embodiments, the method comprises positioning the plurality of storage bins within the cabinet with a removable storage grid, the removable storage grid including the plurality of storage bins. In some embodiments, the method further comprises moving the one or more consumable items from the dispensing area to a food processing device. For example, the food processing device may comprise a fryer.

In some embodiments, moving the one or more consumable items comprises actuating a plunger of the one or more actuators to force the one or more consumable items out of respective storage bins in a consumable item movement direction. Actuating the plunger may comprise, for example, biasing a spring of the plunger in the consumable item movement direction.

In some embodiments, storing the consumable items within the cabinet comprises removing the storage grid from the cabinet, loading the consumable items into the storage grid, returning the storage grid into an installation position within the cabinet.

BRIEF DESCRIPTIONS OF THE DRAWINGS

The above and other objects and advantages of the disclosure may be apparent upon consideration of the following detailed description, taken in conjunction with the accompanying drawings, in which.

DETAILED DESCRIPTION

Apparatuses, methods, and systems are provided herein for dispensing a frozen good from storage.

In the examples herein, the consumable item is illustrated as a food stock for frying (e.g., chicken tenders). However, examples herein may be applied without limitation to other consumable items, or food stock, such as French fries, vegetables, or any other food stock or consumable item that may be frozen for storage before preparation for consumption. Example apparatuses and methods herein may also be directed to the arrangement or positioning of the consumable item in a food preparation system or stations thereof (e.g., for grilling, frying, cutting, or other food preparation processes, merely as examples).

The methods and/or any instructions for performing any of the embodiments discussed herein may be encoded on computer-readable media. Computer-readable media includes any media capable of storing data. The computer-readable media may be transitory, including, but not limited to, propagating electrical or electromagnetic signals, or may be non-transitory including, but not limited to, volatile and non-volatile computer memory or storage devices such as a hard disk, floppy disk, USB drive, DVD, CD, media cards, register memory, processor caches, Random Access Memory (RAM), etc.

Figure 1:
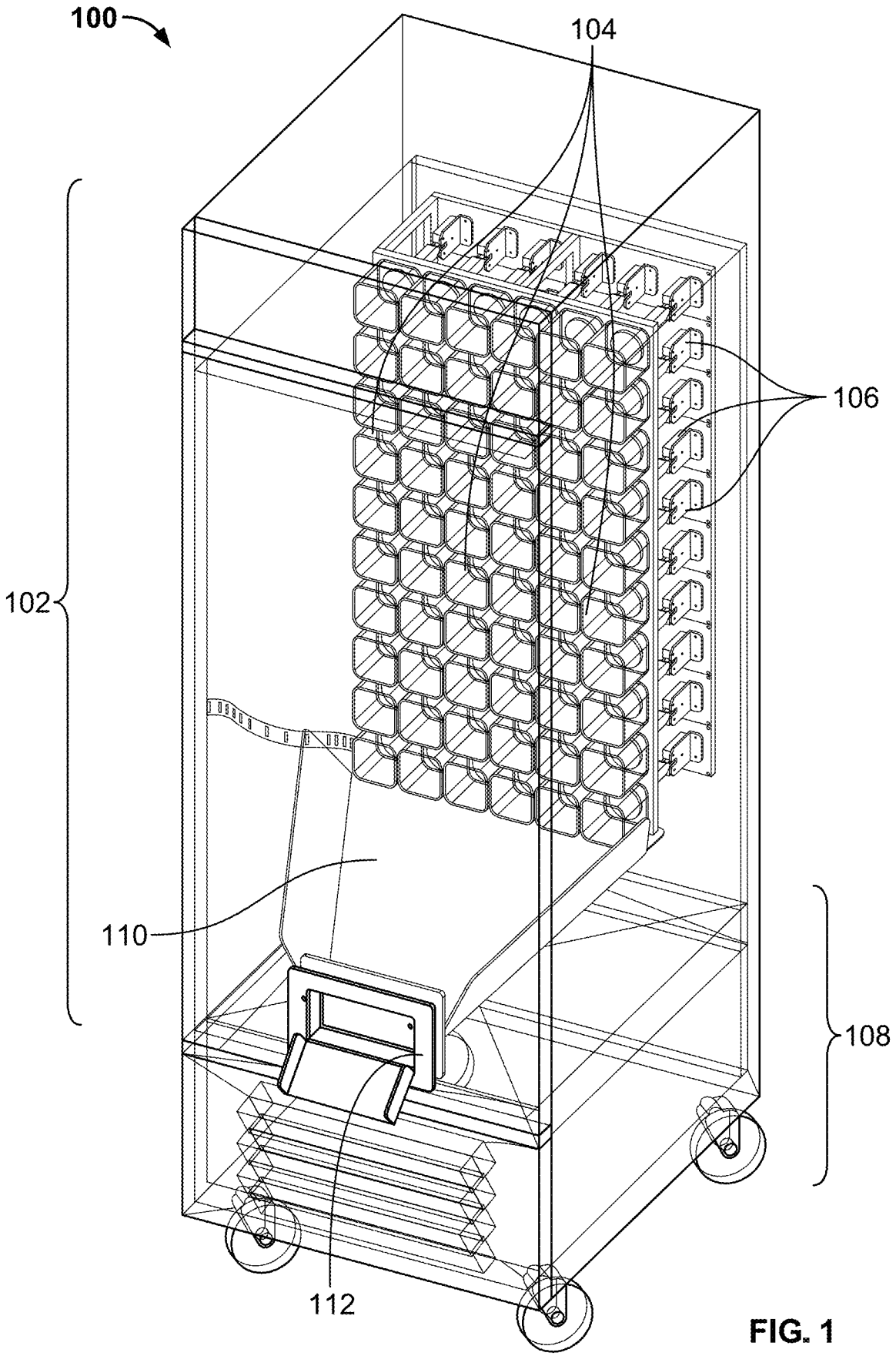
FIG. 1 depicts a perspective view of a food dispensing apparatus, in accordance with some embodiments of the disclosure.

FIG. 1 depicts a food dispensing apparatus 100, in accordance with some embodiments of the disclosure. Food dispensing apparatus 100 may include, in whole or in part, or may be included into, in whole or in part, one or more of assembly 200 of FIG. 2, automated food preparation system 300 of FIG. 3, food dispensing apparatus 400 of FIGS. 4A-4C, mechanism 500 of FIG. 5, loading bin 600A of FIG. 6A, or cabinet 600B of FIG. 6B. Food dispensing apparatus 100 may also be configured to execute, in whole or in part, process 700 of FIG. 7.

Figure 5:
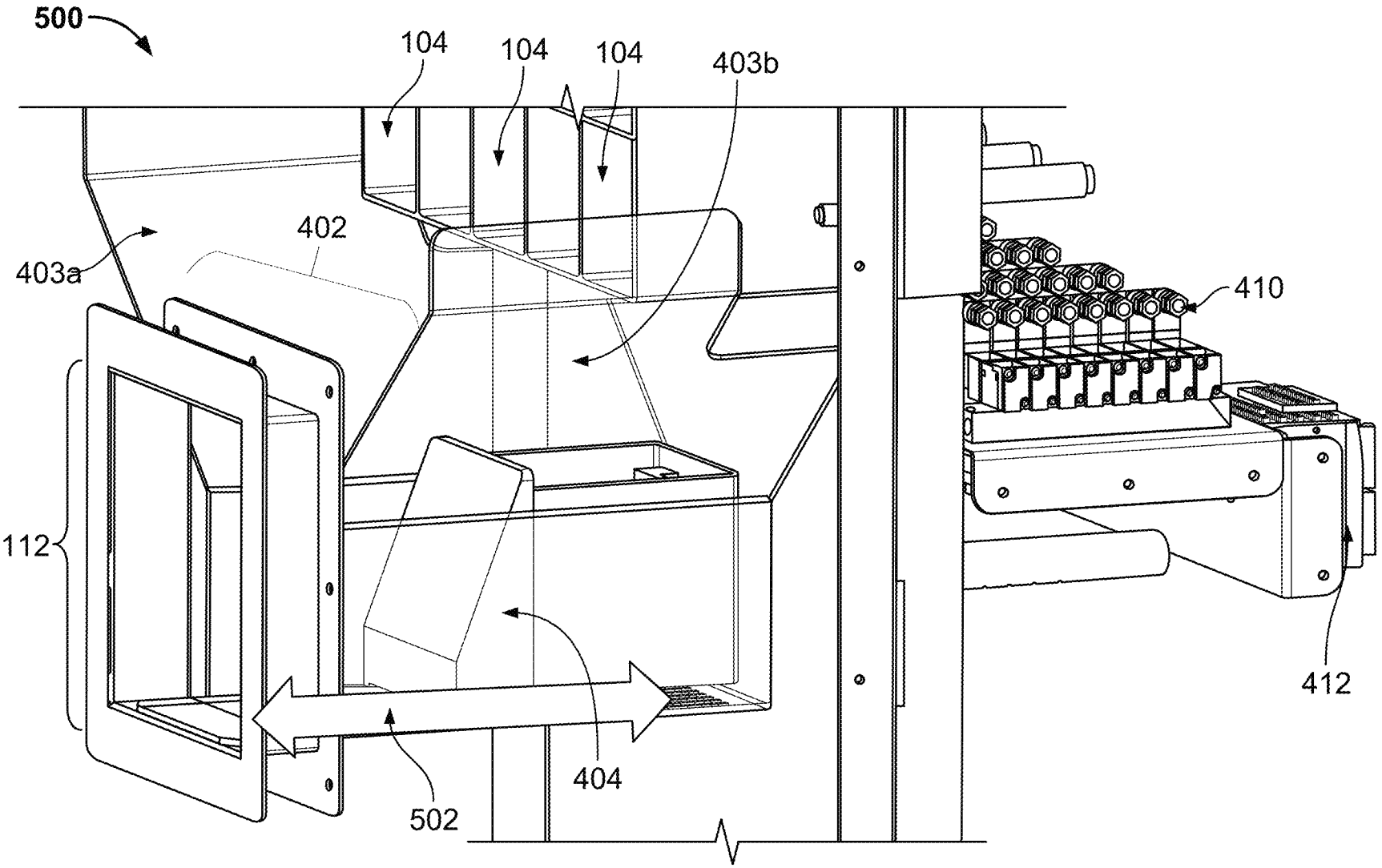
FIG. 5 depicts a mechanism for dispensing a food product from storage, in accordance with some embodiments of the disclosure.

Food dispensing apparatus 100 generally includes food storage cabinet 102, storage bins 104, and actuators 106. Cabinet 102 is arranged on top of cart 108 and includes accumulator chute 110. In some embodiments, accumulator chute 110 may include a pneumatic ejection mechanism (e.g., as shown in FIG. 5) such that food dispensed from storage bins 104 through accumulator chute 110 are pressed towards opening 112 for ease of access of the dispensed consumable item. Alternatively, the accumulator chute 110 may be angled as shown to facilitate food sliding along the accumulator chute 110 and out the opening 112, i.e., without additional moving parts or ejection mechanisms. As shown, food dispensing apparatus 100 includes a plurality of storage bins 104. In some embodiments, storage bins 104 may be considered cubbies or storage cubbies. Each of storage bins 104 may be configured to hold one or more of the consumable items (e.g., one or more pieces of chicken for frying). The consumable items may include pre-portioned food, e.g., one or more chicken strips, nuggets, etc.

Food dispensing apparatus 100 is also comprised of actuators 106. At least one of the actuators 106 may correspond to one or more of storage bins 104. For example, one of actuators 106 may be configured to empty the contents of one of storage bins 104 or one of actuators 106 may be configured to move and empty the contents of multiple of storage bins 104. Actuators 106 are each configured to move the consumable item out of storage bins 104 to a dispensing area. The dispensing area may be accumulator chute 110, which may also be considered a dispense chute. A door, flapper, or the like may be provided to cover opening 112 to generally prevent excess cold air from within cabinet 102 from escaping to the environment surrounding the freezer cabinet, while also permitting exit of food from the opening 112.

Figure 2:
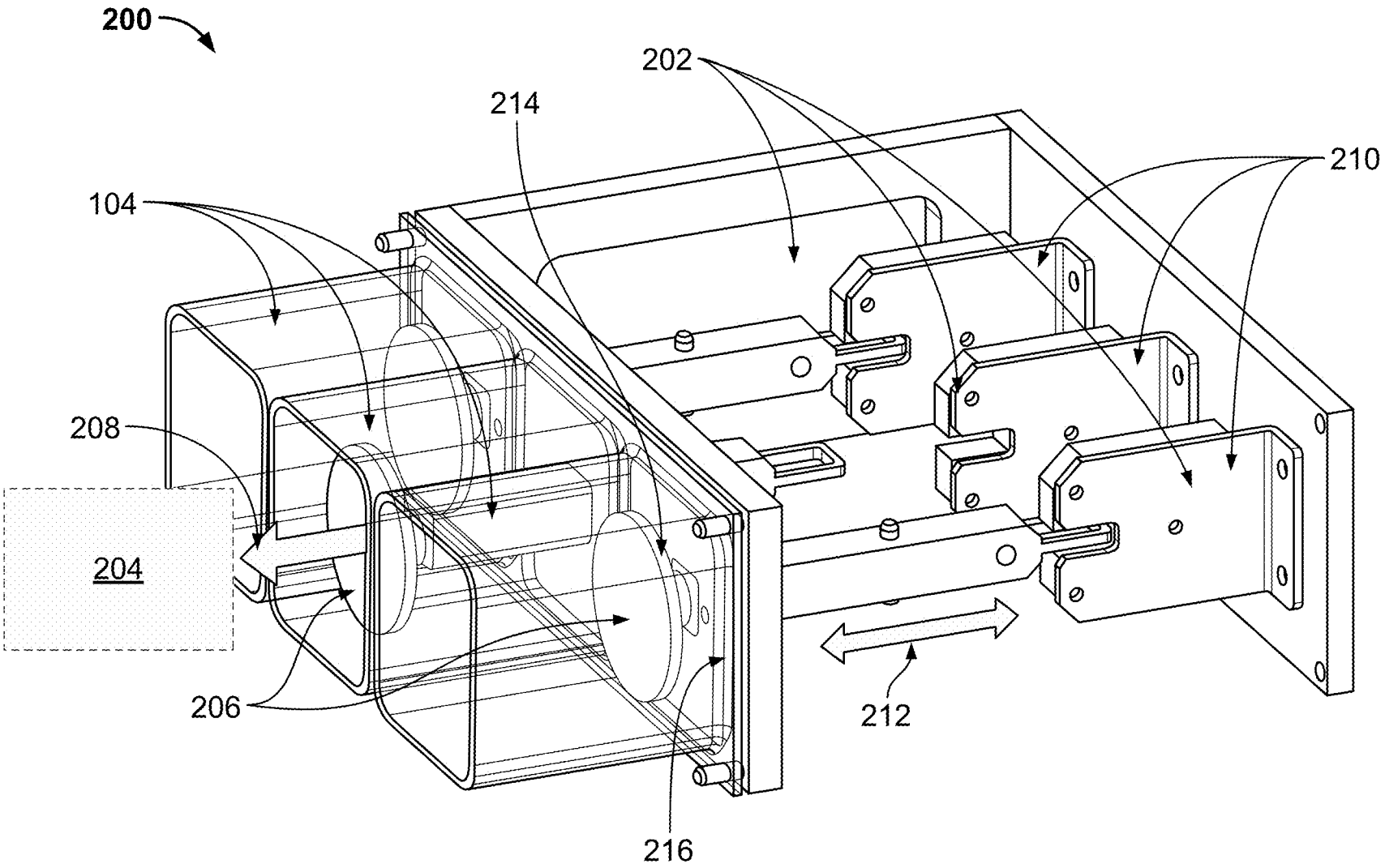
FIG. 2 depicts an assembly of actuators and storage bins, in accordance with some embodiments of the disclosure.

FIG. 2 depicts assembly 200, which generally includes actuators 202 and storage bins 104, in accordance with some embodiments of the disclosure. Assembly 200 may include, in whole or in part, or may be included into, in whole or in part, one or more of food dispensing apparatus 100 of FIG. 1, automated food preparation system 300 of FIG. 3, food dispensing apparatus 400 of FIGS. 4A-4C, mechanism 500 of FIG. 5, loading bin 600A of FIG. 6A, or cabinet 600B of FIG. 6B. Assembly 200 may also be configured to execute, in whole or in part, process 700 of FIG. 7.

In the example assembly 200 illustrated in FIG. 2, the assembly 200 includes three storage bins 104 of FIG. 1 and three respective actuators 202, each arranged to empty the contents of one of storage bin 104. In other examples, other numbers of actuators 202 and/or bins 104. The contents of each bin 104 may comprise one or more consumable items 204 (e.g., one or more pieces of chicken). Actuators 202 are depicted as being comprised of plunger 206, which may be spring loaded in order to force consumable item 204 out of storage bin 104 along item movement direction 208 (e.g., toward a front of food dispensing apparatus 100 of FIG. 1). For example, consumable item 204 may fall downward into accumulator chute 110 of FIG. 1. Actuators 202 may also comprise a spring, which biases plunger 206 in the consumable item movement direction. For example, the spring may be arranged to expand when latch 210 releases plunger stem 212 and force a surface of plunger 206 along consumable item movement direction 208. The spring may remain compressed between rear plunger surface 214 and storage bin end face 216 until latch 210 releases plunger stem 212. Accordingly, latch 210 may release plunger stem 212, with the spring urging plunger 206 along consumable item movement direction 208, and forcing consumable item 204 out of one or storage bins 104. The spring-loaded plungers may each be configured to be "reset" (e.g., such that plunger stem 212 is engaged by latch 210 and the spring is compressed such that rear plunger surface 214 is reset to a position that is the length of the compressed spring away from storage bin end face 216) by kitchen or other personnel resetting and latching the plunger. Alternatively, the resetting of latches 210 may also be automated (e.g., such that the plunger is driven back into the initial position by a motor, separate actuator, or other suitable means).

While the example illustrated in FIG. 2 employs a spring-loaded plunger/latch mechanism, other actuating devices or mechanisms may be employed. Merely as examples, actuating motor(s) may be provided to translate a rotary motion to linear motion, which causes an actuator to move a consumable item out of a cubby. Still other examples may employ a pneumatic cylinder or piston configured to push consumable items from their respective cubbies, or a tip dispense bin configured to tilt or overturn, causing a consumable item located therein to fall out of the bin and into a dispensing area.

In some example approaches, a same number of consumable items may be stored/loaded into the storage bins or cubbies of the apparatus. Merely by way of example, a relatively small number of food items, e.g., a single chicken strip or chicken "finger," may be loaded into each of the storage bins. Accordingly, any number of chicken strips/fingers may be dispensed as desired, e.g., to provide a required number of consumable items for processing/cooking. It should also be noted that while the storage bins illustrated in the Figures are generally sized to fit approximately one chicken strip each, this is not limiting and any size, shape, and number of storage bins may be employed. In another approach, bins are configured to store multiple food items in a standard amount, e.g., three chicken strips, which correspond to a minimum order number or increment between order sizes. In still another example, some bins may be provided with a single food item and others may have multiple food items, thereby facilitating delivery of any number of food items by actuating one or more of the bins to obtain a desired number of food items in an order or request.

Storage bins 104 may be provided in an array or grid positioned such that consumable items fall downward from the bins and into the dispensing area/chute when moved by the actuators. Moreover, as will be described further below, the storage grid may be removable from the freezer cabinet. In an example, the storage grid is configured to be removed from the freezer for loading the consumable items into the storage bins. For example, it may be relatively easier to load consumable items into the storage bins by laying the storage bin array or grid upon a table or other flat surface, e.g., horizontally or generally so, and placing consumable items into each of the storage bins. Subsequently, the storage bin array or grid may be loaded back into the freezer cabinet to a vertical or generally vertical position, with the actuators positioned to dispense each of the consumable items upon demand.

Figure 3:
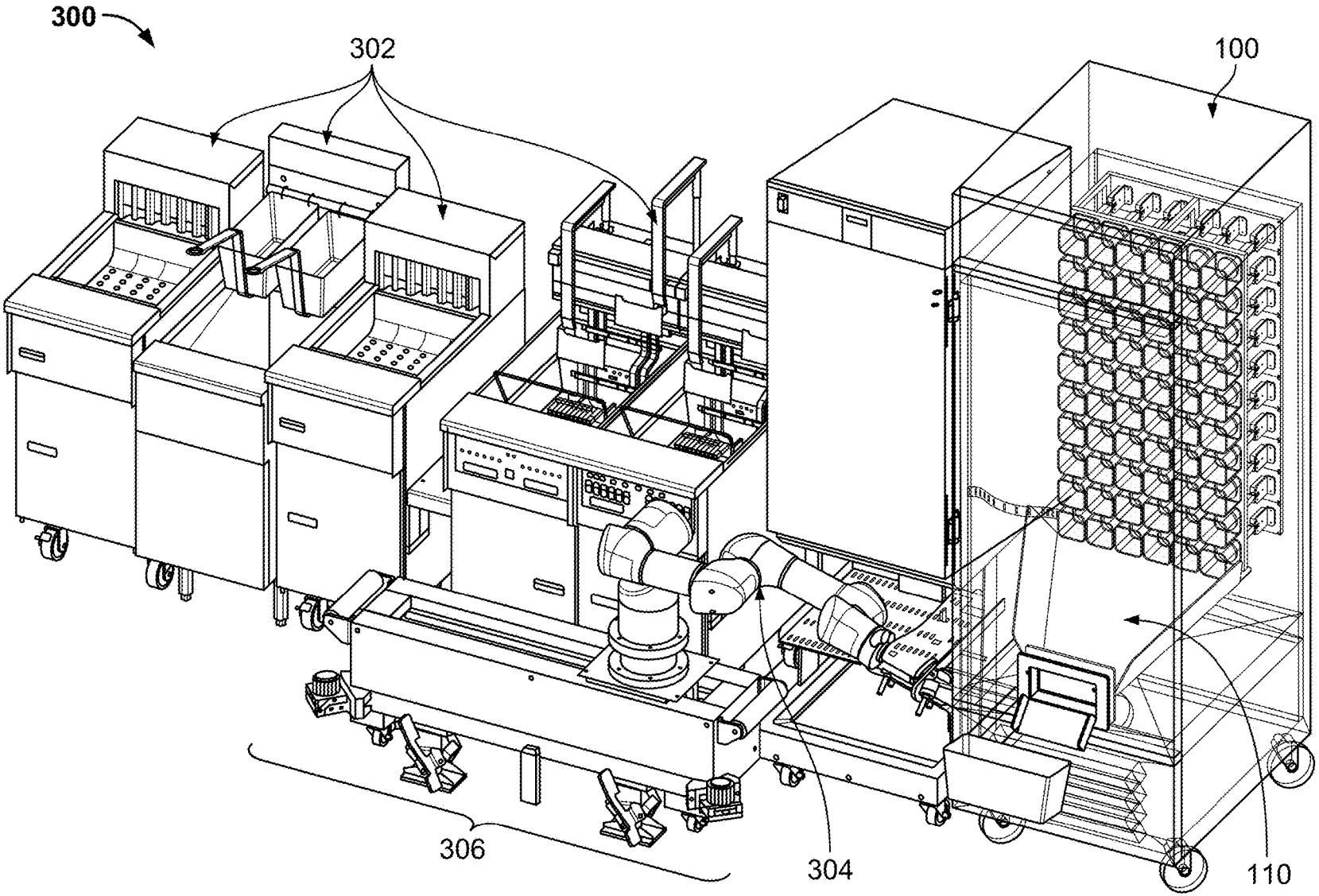
FIG. 3 depicts an automated food preparation system, in accordance with some embodiments of the disclosure.

FIG. 3 depicts automated food preparation system 300, in accordance with some embodiments of the disclosure. Automated food preparation system 300 may include, in whole or in part, or may be included into, in whole or in part, one or more of food dispensing apparatus 100 of FIG. 1, assembly 200 of FIG. 2, food dispensing apparatus 400 of FIGS. 4A-4C, mechanism 500 of FIG. 5, loading bin 600A of FIG. 6A, or cabinet 600B of FIG. 6B. Automated food preparation system 300 may also be configured to execute, in whole or in part, process 700 of FIG. 7.

Automated food preparation system 300 is comprised of cooking stations 302 and food dispensing apparatus 100 of FIG. 1. One or more of cooking stations 302 may, for example, including frying stations, e.g., configured to cook food items in a cooking medium such as oil. Moreover, cooking stations 302 may be comprised of any suitable food preparation station, based on the configuration of automated food preparation system 300 (e.g., grilling stations, boiling stations, defrosting stations, seasoning stations, any suitable food preparation station, or combinations thereof). Robotic arm 304 is configured to grab consumable items from food dispensing apparatus 100 (e.g., from accumulator chute 110), e.g., by way of a basket manipulated by the robotic arm 304. Robotic arm 304 is shown as being able to translate along track 306 in order to place consumable items from food dispensing apparatus 100 into one or more of cooking stations 302. Track 306 may be configured to enable robotic arm 304 to translate between stations of automated food preparation by using wheels, pulleys, magnetics, or any suitable actuation means.

In response to an order for a consumable item (e.g., an order of fried chicken strips), an appropriate number of consumable items may be dispensed from food dispensing apparatus 100, e.g., while in a frozen state within the freezer cabinet. Robotic arm 304 is configured to move the consumable item(s) from the dispensing area (e.g., accumulator chute 110) of food dispensing apparatus 100 to a food processing device (e.g., one or more of cooking stations 302 or a robotic frying system, e.g., as disclosed in the above-mentioned U.S. patent application Ser. No. 17/494,664 and U.S. Provisional Patent Application Ser. No. 63/088,162, each of which are hereby incorporated by reference in their entireties).

Figures 4A, 4B, 4C:
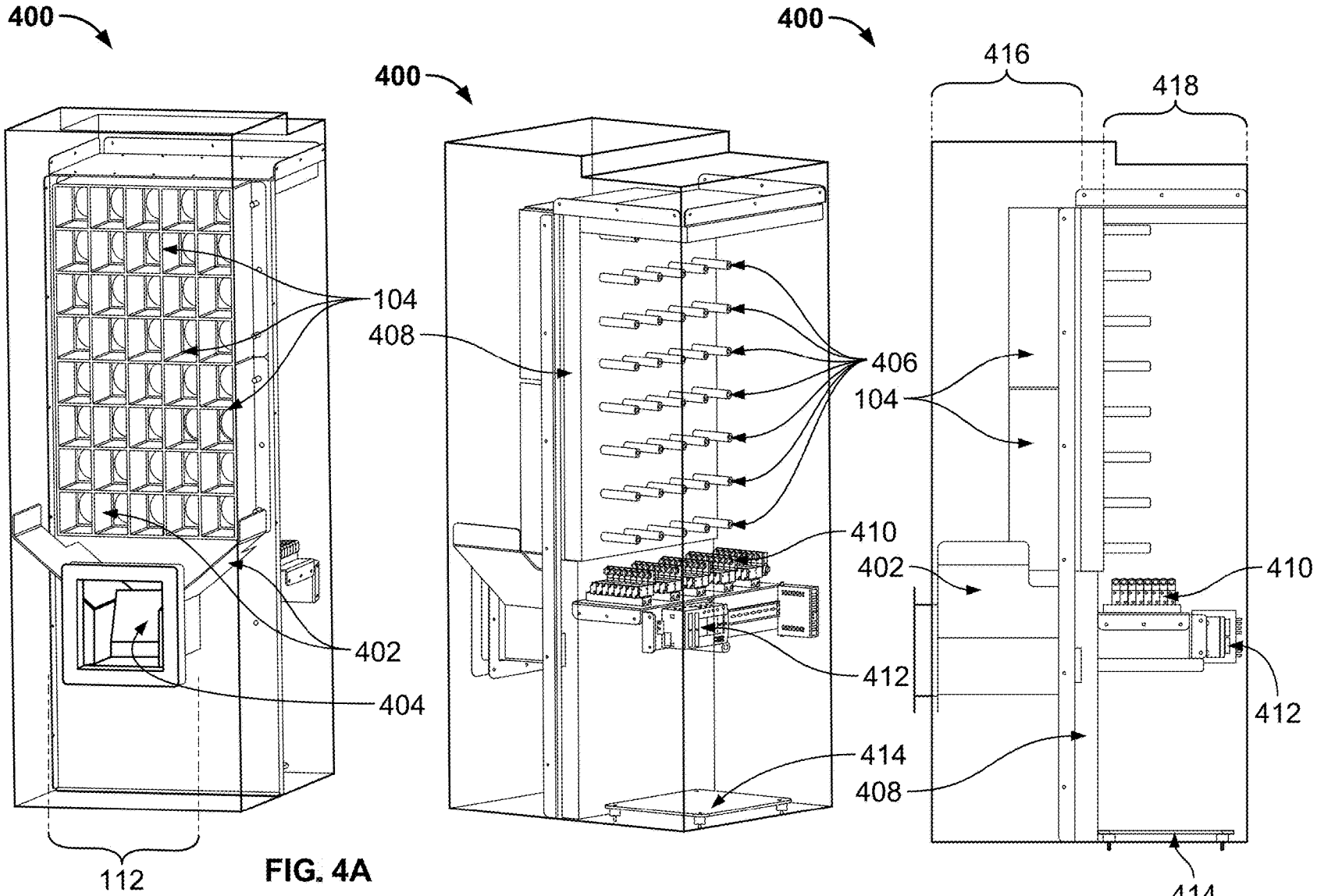
FIG. 4A depicts a front perspective view of a food dispensing apparatus, in accordance with some embodiments of the disclosure.
FIG. 4B depicts a rear perspective view of a food dispensing apparatus, in accordance with some embodiments of the disclosure.
FIG. 4C depicts a side cross-sectional view of a food dispensing apparatus, in accordance with some embodiments of the disclosure.

FIG. 4A depicts a front view of a food dispensing apparatus 400, in accordance with some embodiments of the disclosure. Food dispensing apparatus 400 may include, in whole or in part, or may be included into, in whole or in part, one or more of food dispensing apparatus 100 of FIG. 1, assembly 200 of FIG. 2, automated food preparation system 300 of FIG. 3, food dispensing apparatus 400 of FIGS. 4B and 4C, mechanism 500 of FIG. 5, loading bin 600A of FIG. 6A, or cabinet 600B of FIG. 6B. Food dispensing apparatus 400 may also be configured to execute, in whole or in part, process 700 of FIG. 7.

Food dispensing apparatus 400 generally comprises the elements of food dispensing apparatus 100, and may also include an accumulator chute 402 with a pneumatic ejector 404. The pneumatic ejector 404 may be configured to eject consumable items towards opening 112, for ease of access of the consumable item or for delivery of one or more consumable items to a basket or other collection device. In some embodiments, accumulator chute 402 may comprise the geometry shown via accumulator chute 110 of FIG. 1, where a single channel is formed to guide consumable items to opening 112. As shown in FIG. 4, accumulator chute 402 comprises a pair of angled surfaces forming a channel to guide consumable items centrally with respect to the opening 112, such that the consumable items are positioned in front of a face of pneumatic ejector 404. Accordingly, pneumatic ejector 404 is positioned to force or eject the consumable item(s) towards opening 112 for ease of access. Food dispensing apparatus 400 may also include a grid of storage bins 104. Arranged within each of storage bins 104 are respective plungers (e.g., as shown in FIG. 2).

FIG. 4B depicts an angled rear view of food dispensing apparatus 400, in accordance with some embodiments of the disclosure. As shown in FIG. 4B, food dispensing apparatus 400 is comprised of actuators 406. One or more of actuators 406 may be comprised of pneumatic cylinders or other suitable mechanisms for at least one of releasing or resetting to a pre-release position one or more of the respective plungers in each of storage bins 104. In the illustrated example, the pneumatic cylinders are controlled by solenoid valves to open and close, with the valve control being provided via a main controller such as programmable logic controller 412. The PLC 412 may be configured to provide controller inputs to the pneumatic cylinders to regulate valve positioning and actuation. Arranged around actuators 406 is insulation wall 408 such that the environment corresponding to storage bins 104 remains unaffected (e.g., does not heat up) in response to the operation of actuators 406. Example insulating materials present in the insulation wall 408 may include, merely as examples, a two-part expanding foam or polystyrene rigid insulation. Actuators 406 are communicatively and electrically coupled to solenoid manifold array 410, which is communicatively and electrically coupled to programmable logic controller (PLC) 412. Actuators 406 and pneumatic ejector 404 may be controlled by one or more of PLC 412 or solenoid manifold array 410.

Arranged below PLC 412 is compressor isolation mount 414, which is configured to support a compressor (not shown) that regulates the environmental conditions of storage bins 104 (e.g., keeps the contents of storage bins 104 at a cold temperature prior to being selected for preparing a consumable item). Compressor isolation mount 414 may be arranged in any suitable location with respect to storage bins 104 in order to maintain desired environmental conditions for the contents of storage bins 104. For example, the compressor to be secured to compressor isolation mount 414 may be external to portions of food dispensing apparatus 100 of FIG. 1 that are kept cool for storage of consumable items, e.g., by refrigeration or freezing.

FIG. 4C depicts a side cross-sectional view of food dispensing apparatus 400, in accordance with some embodiments of the disclosure. As shown in FIG. 4C, cold environment 416 generally includes at least areas of the apparatus 400 where storage bins 104 are mounted above accumulator chute 402 and pneumatic ejector 404. Cold environment 416 may be set to any suitable storage temperature for the consumable items stored in storage bins 104 (e.g., typical refrigerator or freezer operating temperatures). Atmospheric environment 418, by contrast, generally corresponds to where solenoid manifold array 410 and PLC 412 are arranged above compressor isolation mount 414. Atmospheric environment 418 is isolated from cold environment 416 via insulation wall 408, and as such does not need to be temperature-controlled and may remain at generally ambient temperatures. Accordingly, cold environment 416 may generally remain at a temperature typical for storage of consumable items within the storage bins 104, thereby facilitating maintenance of the consumable items within the cold environment 416 at cold and/or freezing temperatures typical of storage. Further, insulating material (e.g., two-part expanding foam or polystyrene rigid insulation) within the insulation wall 408 may have a thickness to meet a desired insulation value or insulation coefficient factor magnitude (e.g., R-value) in order to maintain a target refrigeration or freezer temperature within the cold environment 416. In an example, as noted above in some examples temperatures within the storage bins 104 may be maintained at typical refrigeration temperatures (e.g., 40° F./4° C. or below) or typical freezing temperatures (e.g., 0° F.-17° C. or below). Accordingly, an amount or thickness of insulating material and/or the insulating wall 408 may be provided to establish adequate insulation of the cold environment 416 from the atmospheric environment 418. Atmospheric environment 418 may be accessed from behind food dispensing apparatus 400 and is isolated from cold environment 416 to enable ease of service of one or more of the compressor secured to compressor isolation mount 414, actuators 406, solenoid manifold array 410, or PLC 412 without exposing these components to the environmental conditions of cold environment 416. Additionally, this isolation prevents cold environment 416 from being affected during service of components in atmospheric environment 418, from warming effects of equipment within the atmospheric environment 418 such as a compressor for providing refrigeration, etc. Moreover, by reducing the volume of the temperature-controlled cold environment 416 (i.e., to a smaller area within the apparatus 400), a corresponding reduction in energy consumption may be achieved.

FIG. 5 depicts mechanism 500 for dispensing a food product from storage, in accordance with some embodiments of the disclosure. Mechanism 500 may include, in whole or in part, or may be included into, in whole or in part, one or more of food dispensing apparatus 100 of FIG. 1, assembly 200 of FIG. 2, automated food preparation system 300 of FIG. 3, food dispensing apparatus 400 of FIGS. 4A-4C, loading bin 600A of FIG. 6A, or cabinet 600B of FIG. 6B. Mechanism 500 may also be configured to execute, in whole or in part, process 700 of FIG. 7.

Mechanism 500 includes pneumatic ejector 404 arranged below accumulator chute 402. The pneumatic ejector 404 may generally be configured to eject a consumable item received from storage bins 104 (e.g., as shown in FIGS. 1-4C). Accumulator chute 402 includes a pair of angled surfaces 403*a* and 403*b*, which are configured to guide consumable items ejected from storage bins 104 (e.g., via plunger 206 of FIG. 2) towards the front surface of pneumatic ejector 404. Pneumatic ejector 404 is configured to translate along ejection path 502 such that a consumable item can be guided towards and/or through opening 112. Pneumatic ejector 404 may be controlled by one or more of solenoid manifold array 410, PLC 412, or combination of processing circuitry and actuators suitable for this application. Pneumatic ejector 404 prevents a reliance on gravity for ease of access of a consumable items dispensed from one or more of storage bins 104 (e.g., for ease of access of the consumable item by robotic arm 304 of FIG. 3).

Figure 6B:
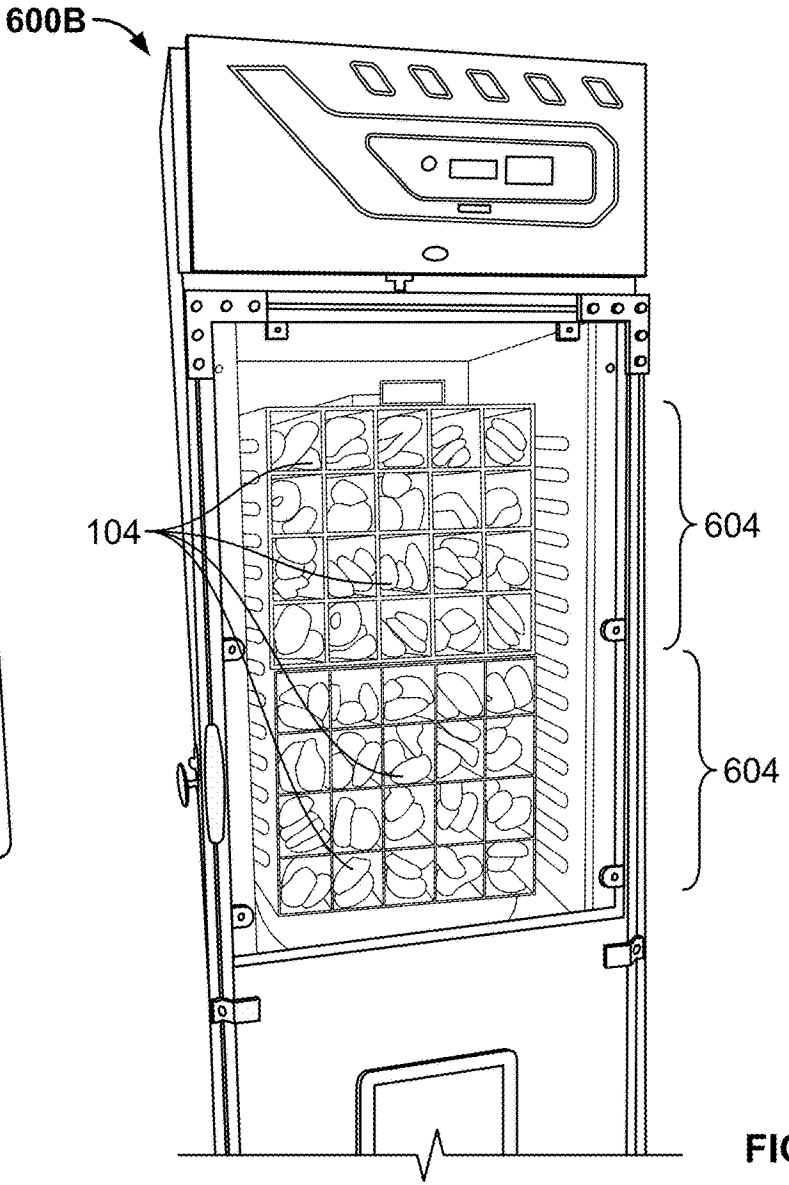
FIG. 6B depicts a loaded storage grid of storage bins in a cabinet, in accordance with some embodiments of the disclosure.
Figure 6A:
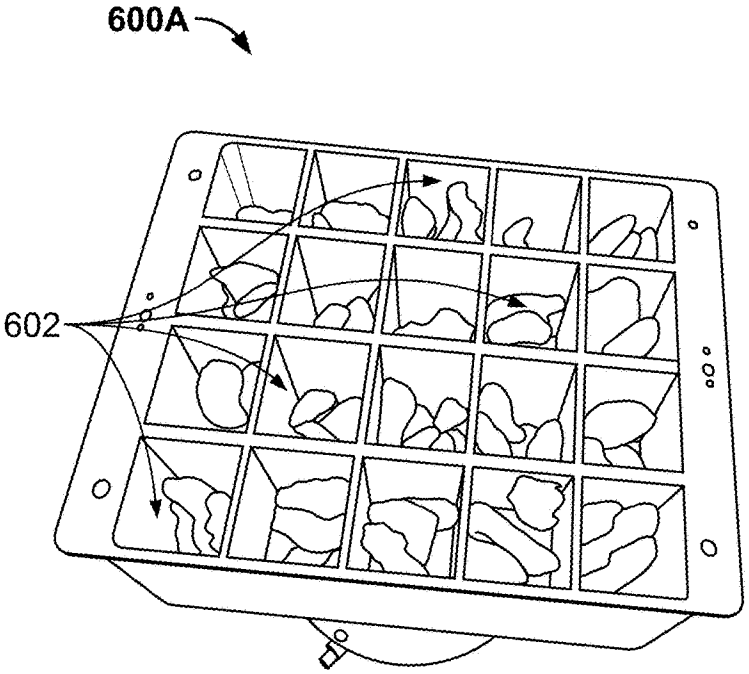
FIG. 6A depicts a storage bin for loading a removable storage grid, in accordance with some embodiments of the disclosure.

FIG. 6A depicts loading bin 600A for loading removable storage grid 604 of stocked cabinet 600B of FIG. 6B, in accordance with some embodiments of the disclosure. Bin 600A may include, in whole or in part, or may be included into, in whole or in part, one or more of food dispensing apparatus 100 of FIG. 1, assembly 200 of FIG. 2, automated food preparation system 300 of FIG. 3, food dispensing apparatus 400 of FIGS. 4A-4C, mechanism 500 of FIG. 5, or cabinet 600B of FIG. 6B. Bin 600A may also be configured to execute, in whole or in part, process 700 of FIG. 7.

Bin 600A is configured to receive a plurality of consumable items in storage slots 602. Storage slots 602 are configured to receive the consumable items for ease of loading into storage bins 104 of stocked cabinet 600B. In some embodiments, stocked cabinet 600B comprises one or more of grids 604, each comprised of respective pluralities of storage bins 104. Storage slots 602 are arranged in a grid within bin 600A that aligns with the arrangement of storage bins 104 in stocked cabinet 600B, thereby generally facilitating restocking or reloading each of grids 604 of stocked cabinet 600B.

FIG. 6B depicts stocked cabinet 600B, in accordance with some embodiments of the disclosure. Stocked cabinet 600B, in whole or in part, or may be included into, in whole or in part, one or more of food dispensing apparatus 100 of FIG. 1, assembly 200 of FIG. 2, automated food preparation system 300 of FIG. 3, food dispensing apparatus 400 of FIGS. 4A-4C, mechanism 500 of FIG. 5, or loading bin 600A of FIG. 6A. Stocked cabinet 600B may also be configured to execute, in whole or in part, process 700 of FIG. 7.

Stocked cabinet 600B generally includes two removable grids 604. In some embodiments, stocked cabinet 600B is comprised of more or less than two of grids 604. Each of grids 604 may correspond to bin 600A in that grids 604 may each be a mounted bin 600A within stocked cabinet 600B. For example, each of grids 604 may be comprised of a grid of storage slots 602 with mounting features arranged on one or more edges of grids 604 for securing one or more of grids 604 to a feature or wall internal to stocked cabinet 604.

Figure 7:
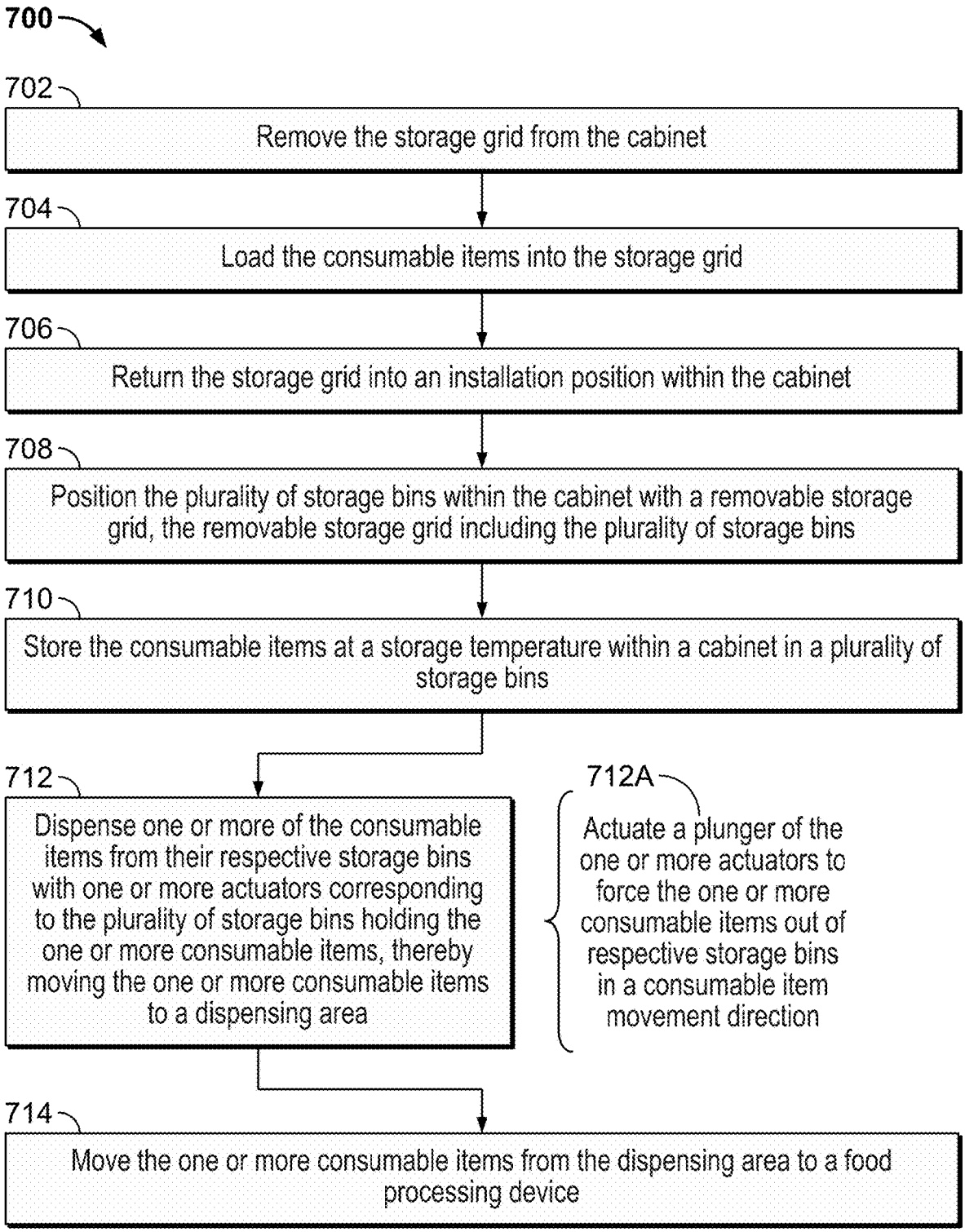
FIG. 7 is a flow chart representing an illustrative method of dispensing food products, in accordance with some embodiments of the disclosure.

FIG. 7 is a flow chart of an example process 700 of dispensing food products, in accordance with some embodiments of the disclosure. Process 700 may be executed, in whole or in part, by an assembly, a system, or a component depicted, in whole or in part, via one or more of dispensing apparatus 100 of FIG. 1, assembly 200 of FIG. 2, automated food preparation system 300 of FIG. 3, food dispensing apparatus 400 of FIGS. 4A-4C, mechanism 500 of FIG. 5, loading bin 600A of FIG. 6A, or cabinet 600B of FIG. 6B.

Process 700 may begin at block 702. At block 702, the storage grid may be removed from the cabinet (e.g., one or more of grids 604 of FIG. 6 are removed from food dispensing apparatus 100 of FIG. 1). At block 704, the consumable items may be loaded into the storage grid (e.g., as shown in FIG. 6A). At block 706, the storage grid may be returned into an installation position within the cabinet (e.g., as shown in FIG. 6B). At block 708, the plurality of storage bins may be positioned within the cabinet with the removable storage grid (e.g., as described in reference to elements 702-706), and the removeable storage grid includes the plurality of storage bins. At block 710, the consumable items are stored at a storage temperature within a cabinet in a plurality of storage bins (e.g., stored within cold environment 416 of FIG. 4C at a temperature corresponding to the operating temperature of one or more of a refrigerator or freezer). At block 712, one or more of the consumable items are dispensed from their respective storage bins (e.g., storage bins 104), with one ore more actuators (e.g., plungers 206 of FIG. 2) corresponding to the plurality of storage bins holding the one or more consumable items, thereby moving the one or more consumable items to a dispensing area (e.g., opening 112). For example, at block 712A, a plunger of the one or more actuators is actuated to force the one or more consumable items out of respective storage bins in a consumable item movement direction (e.g., consumable item movement direction 208 of FIG. 2). In some embodiments, actuating the plunger comprises biasing a spring of the plunger in the consumable item movement direction. At block 714, the one or more consumable item is moved from the dispensing area to a food processing device (e.g., via robotic arm 304 to move the item to one or more of cooking stations 302).

Example methods of dispensing consumable items may include storing the consumable items at a storage temperature within a cabinet in a plurality of storage bins. The cabinet may maintain the consumable items at a desired storage temperature, which may be any desired temperature. In at least some examples, the cabinet is a freezer configured to maintain a generally frozen state of the consumable items. The method may also include dispensing one or more of the consumable items from their respective storage bins with one or more actuators corresponding to the plurality of storage bins holding the one or more consumable items, thereby moving the one or more consumable items to a dispensing area.

At least some example methods may further include positioning the plurality of storage bins within the cabinet with a removable storage grid, the removable storage grid including the plurality of storage bins. For example, as noted above, a removable storage grid or array may facilitate loading of the storage bins with consumable items. Moreover, to the extent the cabinet maintains the consumable items at a storage temperature that is significantly different from ambient temperature, e.g., as with a freezer or oven, the storage grid may facilitate rapid loading and minimize an amount of time needed to load the consumable items into the cabinet, and thereby reduce heat/cold losses.

At least some example methods may also include moving the one or more consumable items from the dispensing area to a food processing device, e.g., a fryer.

The foregoing is merely illustrative of the principles of this disclosure and various modifications may be made by those skilled in the art without departing from the scope of this disclosure. The embodiments described herein are provided for purposes of illustration and not of limitation. Thus, this disclosure is not limited to the explicitly disclosed systems, devices, apparatuses, components, and methods, and instead includes variations to and modifications thereof, which are within the spirit of the attached claims.

The systems, devices, apparatuses, components, and methods described herein may be modified or varied to optimize the systems, devices, apparatuses, components, and methods. Moreover, it will be understood that the systems, devices, apparatuses, components, and methods may have many applications such as monitoring of liquids other than water. The disclosed subject matter should not be limited to any single embodiment described herein, but rather should be construed according to the claims.

The systems and processes discussed above are intended to be illustrative and not limiting. One skilled in the art would appreciate that the actions of the processes discussed herein may be omitted, modified, combined, and/or rearranged, and any additional actions may be performed without departing from the scope of the invention. More generally, the above disclosure is meant to be exemplary and not limiting. Only the claims that follow are meant to set bounds as to what the present disclosure includes. Furthermore, it should be noted that the features and limitations described in any one embodiment may be applied to any other embodiment herein, and flowcharts or examples relating to one embodiment may be combined with any other embodiment in a suitable manner, done in different orders, or done in parallel. In addition, the systems and methods described herein may be performed in real time. It should also be noted that the systems and/or methods described above may be applied to, or used in accordance with, other systems and/or methods.

While some portions of this disclosure may refer to examples, any such reference is merely to provide context to the instant disclosure and does not form any admission as to what constitutes the state of the art.

What is claimed is:

1. A food dispensing apparatus, comprising:

a food storage cabinet configured to maintain a plurality of unpackaged consumable items at a storage temperature below ambient temperature;

a plurality of storage bins forming a storage grid within the cabinet, wherein the storage grid is configured to be removed from the cabinet for loading the consumable items into the storage bins, the storage bins each defined by sidewalls configured to hold a pre-portioned amount of the unpackaged consumable items and defining an open discharge end configured to dispense the pre-portioned amount of the unpackaged consumable items from the storage bin;

a plurality of actuators corresponding to the plurality of storage bins, the actuators each configured to empty one of the storage bins by moving the pre-portioned amount of the consumable item out of the storage bin to a dispensing area of the food storage cabinet via a discharge chute;

a basket configured to receive the pre-portioned amount of the unpackaged consumable items from the discharge chute; and a robot arm configured to articulate and manipulate the basket between the dispensing area and a cooking station to transport the basket with the pre-portioned amount of the unpackaged consumable items to the cooking station.

2. The apparatus of claim 1, further comprising:

an accumulator chute configured to receive one or more consumable items from at least one of the plurality of storage bins; and a pneumatic ejector configured to translate the one or more consumable items towards an opening in the cabinet along an ejection path.

3. The apparatus of claim 1, further comprising an insulating wall configured to insulate the cabinet from an atmospheric temperature zone of the apparatus and configured to facilitate access to the actuators.

4. The apparatus of claim 1, wherein the actuators each comprise a plunger extending into one of the storage bins and configured to force the pre-portioned amount of the consumable item out of the storage bin in a consumable item movement direction generally parallel to the sidewalls.

5. The apparatus of claim 4, wherein the actuators each comprise a spring biasing the plunger in the consumable item movement direction.

6. The apparatus of claim 4, wherein the actuators each comprise a pneumatic cylinder configured to move the plunger in the consumable item movement direction.

7. A method for dispensing unpackaged consumable items, comprising:

storing the unpackaged consumable items at a storage temperature below ambient temperature within a cabinet in a plurality of storage bins forming a storage grid, wherein each of the storage bins is defined by sidewalls configured to hold a pre-portioned amount of the unpackaged consumable items, the sidewalls of each storage bin defining an open discharge end configured to dispense the pre-portioned amount of the unpackaged consumable items from the storage bin;

dispensing the unpackaged pre-portioned quantity of consumable items from a first storage bin of the plurality of storage bins by displacing an actuator from a location within the first storage bin in a consumable item movement direction toward the discharge end, thereby emptying the first storage bin and moving the unpackaged pre-portioned quantity of consumable items to a dispensing area of the cabinet via a discharge chute, wherein the pre-portioned quantity of the unpackaged consumable items are received by a basket; and articulating a robotic arm to transport the basket between the dispensing area and a cooking station and transport the basket with the pre-portioned quantity of the unpackaged consumable items to the cooking station, thereby moving the one or more consumable items from the dispensing area to a food processing device.

8. The method of claim 7, wherein storing the consumable items within the cabinet comprises:

removing the storage grid from the cabinet;

loading the consumable items into the storage grid; and returning the storage grid into an installation position within the cabinet.

9. The method of claim 7, wherein moving the one or more consumable items comprises actuating a plunger of the one or more actuators to force the one or more consumable items out of respective storage bins in the consumable item movement direction.

10. The method of claim 9, wherein actuating the plunger comprises biasing a spring of the plunger in the consumable item movement direction.

11. An apparatus, comprising:

a food storage cabinet configured to maintain a plurality of unpackaged consumable items at a storage temperature below ambient temperature;

a grid of storage bins mounted on a vertical wall of the food storage cabinet, the storage bins each defined by sidewalls extending horizontally relative to the vertical wall and configured to hold a pre-portioned amount of the unpackaged consumable items, the horizontally extending sidewalls of each storage bin defining an open discharge end configured to dispense the pre-portioned amount of the unpackaged consumable items from the storage bin and an actuator receiving end opposite the discharge end;

an actuator array mounted on a vertical wall of the food storage cabinet and including actuation means extending into the actuator receiving end of each of the storage bins for discharging the pre-portioned amount of the unpackaged consumable items, the food storage cabinet including a dispensing area configured to receive the pre-portioned amount of the unpackaged consumable items from the grid of storage bins, the dispensing area including a discharge chute configured to receive and discharge the pre-portioned amount of the unpackaged consumable items external to the food storage cabinet;

a basket configured to receive the pre-portioned amount of the unpackaged consumable items; and a robotic arm configured to articulate and manipulate and transport the basket between the dispensing area and a cooking station to receive the pre-portioned amount of the unpackaged consumable items from the discharge chute in the basket and transport the pre-portioned amount of the unpackaged consumable items to the cooking station.

12. The apparatus of claim 11, wherein the grid of storage bins is configured to be removed from the food storage cabinet for resupplying the pre-portioned amount of unpackaged consumable items to the storage bins.

* * * * *